US011793279B2

(12) United States Patent
Coles et al.

(10) Patent No.: US 11,793,279 B2
(45) Date of Patent: Oct. 24, 2023

(54) FASTENERS

(71) Applicant: HCL Fasteners Limited, Bath (GB)

(72) Inventors: David Coles, Bath and North East Somerset (GB); Benjamin Beckett, Radstock (GB)

(73) Assignee: HCL Fasteners Limited, Bath (GB)

( * ) Notice: Subject to any disclaimer, the term of this patent is extended or adjusted under 35 U.S.C. 154(b) by 356 days.

(21) Appl. No.: 16/483,182

(22) PCT Filed: Feb. 2, 2018

(86) PCT No.: PCT/GB2018/050312
§ 371 (c)(1),
(2) Date: Aug. 2, 2019

(87) PCT Pub. No.: WO2018/142156
PCT Pub. Date: Aug. 9, 2018

(65) Prior Publication Data

US 2020/0229546 A1 Jul. 23, 2020

(30) Foreign Application Priority Data

Feb. 3, 2017 (GB) ..... 1701842

(51) Int. Cl.
*B65D 63/10* (2006.01)
*A44B 11/25* (2006.01)

(52) U.S. Cl.
CPC ..... *A44B 11/2592* (2013.01); *B65D 63/1018* (2013.01)

(58) Field of Classification Search
CPC ..... A44B 11/2592; B65D 63/1018
See application file for complete search history.

(56) References Cited

U.S. PATENT DOCUMENTS 3,224,056 A * 12/1965 Joffe ..... B65D 63/1081 24/16 R
3,747,164 A * 7/1973 Fortsch ..... B65D 63/16 24/16 PB
4,008,512 A * 2/1977 Prodel ..... F16L 3/2334 24/16 PB
4,272,870 A * 6/1981 McCormick ..... B65D 63/1072 24/16 PB (Continued)

FOREIGN PATENT DOCUMENTS

FR 2707352 A1 1/1995
GB 2308153 A 6/1997

(Continued)

OTHER PUBLICATIONS

"International Search Report"; prepared for PCT/GB2018/050312; authorized officer Frank van Voorst; dated Mar. 21, 2018; 6 pages.

(Continued)

*Primary Examiner* — Jason W San
(74) *Attorney, Agent, or Firm* — Winstead PC

(57) ABSTRACT

A fastener (1) has an elongate fastening band (2) and a buckle (10) for engagement with the band (2) to form a closed loop fastener. The buckle (10) is overmoulded on a first end region (8) of the fastening band (2). Such a design provides a fastener that has higher strength and is more compact than previously-considered designs.

10 Claims, 7 Drawing Sheets

(56) References Cited

U.S. PATENT DOCUMENTS

| | | | | |
|---|---|---|---|---|
| 4,393,548 | A * | 7/1983 | Herb | H02G 3/30 24/16 PB |
| 4,680,834 | A * | 7/1987 | Andre | F16L 3/2336 24/16 PB |
| 4,776,067 | A * | 10/1988 | Sorensen | B65D 63/1072 24/16 PB |
| 4,882,813 | A * | 11/1989 | Nakamura | B65D 63/16 24/16 PB |
| 5,911,367 | A | 6/1999 | McInerney | |
| 6,763,553 | B2 * | 7/2004 | Hatch | B65D 63/1027 24/16 PB |
| 7,360,281 | B1 * | 4/2008 | MacCartey | B65D 63/1063 24/16 PB |
| 7,437,804 | B1 * | 10/2008 | Geiger | F16L 3/237 24/16 PB |
| 7,882,598 | B2 * | 2/2011 | Coles | B65D 63/16 24/16 PB |
| 8,035,518 | B2 * | 10/2011 | Kolton | G02C 11/00 340/572.1 |
| 8,109,968 | B2 * | 2/2012 | Ashley | A61B 17/0487 606/232 |
| 8,336,834 | B2 * | 12/2012 | Matsumoto | H02G 3/30 248/74.1 |
| 8,559,782 | B2 * | 10/2013 | Cleofe | H02G 3/30 385/134 |
| 9,067,717 | B2 * | 6/2015 | DeMik | F16B 7/0433 |
| 9,210,969 | B2 * | 12/2015 | Wheelwright | A44B 11/2592 |
| 9,643,764 | B1 * | 5/2017 | Huang | B65D 63/1072 |
| 10,053,268 | B1 * | 8/2018 | Sickenberger | B65D 63/1063 |
| 10,329,063 | B2 * | 6/2019 | Sylvester | B65D 63/1063 |
| 10,427,849 | B2 * | 10/2019 | Rogers | B65D 63/1072 |
| 10,448,712 | B2 * | 10/2019 | Nipke | A44C 15/005 |
| 10,683,150 | B2 * | 6/2020 | Dinh | B65D 63/1072 |
| 10,717,572 | B2 * | 7/2020 | Wiles | B65D 63/1072 |
| 11,109,648 | B1 * | 9/2021 | Crawford | A44B 11/266 |
| 2005/0015937 | A1 | 1/2005 | Huang | |
| 2008/0083095 | A1 | 4/2008 | Coles et al. | |
| 2010/0146742 | A1 * | 6/2010 | Every | B65D 63/1063 24/16 PB |
| 2011/0271491 | A1 * | 11/2011 | Clawson | B65D 63/1018 24/16 PB |
| 2011/0271492 | A1 | 11/2011 | Posner | |
| 2013/0042446 | A1 | 2/2013 | Tseng | |
| 2014/0315455 | A1 * | 10/2014 | Simon | B63B 32/77 441/75 |
| 2015/0113772 | A1 * | 4/2015 | Dering | A45F 5/00 24/591.1 |
| 2016/0150857 | A1 * | 6/2016 | Botkus | A44B 11/2592 24/615 |
| 2016/0355310 | A1 * | 12/2016 | Rogers | B65D 63/1072 |
| 2017/0050786 | A1 * | 2/2017 | Kozminkse | B65D 63/1027 |
| 2017/0313484 | A1 * | 11/2017 | Na | F16B 2/08 |
| 2018/0078001 | A1 * | 3/2018 | Babin | A44B 11/2561 |
| 2020/0390200 | A1 * | 12/2020 | Noll | A44B 19/30 |

FOREIGN PATENT DOCUMENTS

| | | | |
|---|---|---|---|
| WO | WO-2006/040524 | A1 | 4/2006 |
| WO | WO-2009/001079 | A1 | 12/2008 |
| WO | WO-2010/096197 | A1 | 8/2010 |

OTHER PUBLICATIONS

"Examination and Search Report"; prepared for GB1701842.5; dated May 4, 2017; 11 pages.

* cited by examiner

FASTENERS

The present invention relates to fasteners of the type comprising a band and a buckle for securing the band in a closed loop around at least one object. In particular, the present invention relates to fasteners that compress or clamp the object or object encircled by the band, that is to say the band is under tension in use.

BACKGROUND OF THE INVENTION

Fasteners having a buckle and a band that can be formed into a closed loop, with at least one end of the band being held by teeth within the buckle are well known, for example UK patent GB1600601. In this arrangement, the buckle includes a pair of jaws, each having inwardly-facing teeth, which engage with teeth on the top and bottom surfaces of the band. The buckle has a substantial thickness that can snag other objects. For example, in underwater applications, the buckle could snag on fishing nets, diver's wetsuits/breathing apparatus. Also, when the band is secured around an object that is moved, for example a pipe, it stands proud of the pipe and can catch on other objects and/or damage other objects that come into contact with the pipe.

WO00/00407 describes a fastener having a toothed band having two ends. One end of the band is secured by a pair of toothed jaws in the buckle, which engage with the teeth on the band. The buckle also includes a passageway provided with a second pair of jaws; the second end of the band, after it has been formed into a closed loop, is fed into the passageway and through the pair of jaws. The teeth on the jaws engage with the teeth on the second end of the band to hold it in a closed-loop configuration. In order to tighten the band around an object, the portion of the second end that has passed through the second pair of jaws can be grasped to increase the tension in the band. Like the arrangement described in GB1600601, the buckle is relatively tall and can snag on other objects. In addition, the free, second end band can also catch on nets and other objects.

Simple cable ties include a pair of jaws, at least one of which includes teeth and engage with teeth on the band of the cable tie. The back of the pair of jaws is open so that the free end of the cable tie can be pulled through to tighten the tie. It is also known to cut off the excess part of the cable tie that has passed through the pair of jaws but this generally leads to a sharp, ragged edge that can damage other objects if pressed against them.

GB2308153 discloses a cable tie having a flexible toothed band and a buckle secured at one end of the band. The buckle has a passageway through it; the free end of the band is fed in through one end of the passageway and out through the other end. The passageway has a set of one or more of teeth in the passageway that engage corresponding teeth on the band and so prevent the band being pulled back through the passageway. The band can be tightened by grasping the free end of the band that has been pushed through the buckle, and so is protruding, and pulling on the free end. The set of teeth can be accessed through an opening in the top of the buckle to release the teeth from the band and hence allow the free end of the band to be pulled back through the passageway, thereby releasing the tie.

U.S. Pat. No. 4,882,813 describes a banding clip having a toothed band and a buckle that holds the two ends of the band in a closed loop around articles being banded. The ends of the bands are located at different heights to each other such that one end is located above the level of the other. Furthermore, one free end of the band extends beyond the buckle.

EP1817240 describes a fastener including a band having a first and second ends and teeth provided on at least the first end, and a buckle for holding the band in a closed loop, the buckle having an inner face configured to be directed towards the inside of the loop, when formed, and an outer face opposed to the inner face. The buckle comprises a passageway for receiving the first end of the band, the passageway including at least one tooth that is arranged to engage the teeth on the first end of the band and prevent the band from being pulled out of the passageway, and a chamber located at one end of the passageway and having an opening in the outer face of the buckle, the chamber being accessible, through the opening, from outside the buckle to enable a leading part of the first end of the band that has passed through the passageway to be engaged and pulled through the passageway, and wherein said chamber is configured to accommodate the leading part of the first end; wherein the passageway either terminates in the chamber or a second passageway is provided that is a continuation of the passageway, which second passageway is configured to receive the second end of the band and includes at least one tooth that is arranged to engage the teeth on the second end of the band and prevent the band from being pulled out of the second passageway.

EP2164768 describes a fastener having a buckle and a band, and configured to compress or clamp an article or articles encircled by the band. The band has first and second ends and teeth provided on at least the first end for use in holding the band in a closed loop. The buckle comprises a body, a jaw that is connected to the body and that carries at least one tooth for engaging the teeth on the first end of the band and thereby holding the first end of the band when formed in a closed loop The buckle body comprises a passage for holding an end of the band, the body and the jaw being separate components and made of different materials The jaw is resiliently biased towards the passage. EP2164768 describes a fastener that is manufactured as a single piece moulding, which includes both the band and the buckle. Such manufacturing can be complex and costly, due to the need for a large mould to allow for longer lengths of band. In addition, the length of the band is limited, typically to less than 1*m*, by limitations in moulding techniques.

Accordingly, it is desirable to provide a fastener that is able to be manufactured using simplified forming techniques such as extrusion and smaller injection moulding techniques. It is also desirable to produce a fastening band that has improved strength, and that can be of a length tailored to each application.

SUMMARY OF THE INVENTION

Aspects of the present invention are set out in the attached claims.

According to one aspect of the present invention, there is provided a fastener comprising an elongate fastening band having a longitudinal axis and first and second planar surfaces, the longitudinal axis defining a longitudinal axis of the fastener, the first surface defining a plurality of teeth arranged substantially perpendicular to the longitudinal axis, and the second surface providing an engagement surface for the fastener, wherein the elongate fastening band has a first end region, and a locking portion which is spaced apart longitudinally from the first end region, the first end region and locking portion defining respective groups of such teeth on the first surfaces thereof; and a buckle fused with the teeth of the first end region of the elongate fastening band, the buckle and elongate fastening band being arrangeable to form a closed fastener configured to compress or clamp at least one article encircled by the elongate fastening band, and the buckle comprising a body defining an inner chamber, and having first and second end walls to respective opposite ends of the inner chamber and defining first and second passages therethrough, which passages are contiguous with the inner chamber and which are adapted for receiving the locking portion of the elongate fastening band therethrough, the body further having upper and lower walls to respective upper and lower sides of the inner chamber, the upper wall defining an access aperture therethrough such that the inner chamber is open to the upper side thereof; and a locking component located through the access aperture into the inner chamber, the locking component having at least one tooth for engaging the teeth on the first surface of the locking portion of the fastening band, the locking component being resiliently biased into the inner chamber of the body so as to engage the teeth of the fastening band when the fastener is formed in a closed loop.

In one example, the buckle is fused to the teeth of the first end region of the fastening band using a moulding process.

In one example, the buckle is overmoulded onto the first end region of the fastening band.

In one example, the first end region of the fastening band extends into the lower wall, and a portion of the first end region at least partially overlaps the inner chamber of the body. In such an example, the second passage may overlap a portion of the first end region of the fastening band.

In one example, the body and the locking component are separate to one another and are of different materials, and the locking component is releasably connected to the body.

In one example, the elongate fastening band includes at least one reinforcing element that extends substantially parallel through the fastening band between the first and second planar surfaces thereof. The reinforcing element may be a fibre, a yarn, wire or other elongate element. The reinforcing element may be of glass fibre, steel or aramid, for example. The reinforcing fibre preferably extends longitudinally along the band.

In one example, the band is of a first polymer material, and the body of the buckle is of a second polymer material. In one example, band and body of the buckle are of the same polymer material.

According to another aspect of the present invention, there is provided a method of securing a first object to a second object, the method comprising providing a fastener according to the first aspect of the present invention, encircling the first and second objects with the fastening band, inserting a second end of the fastening band into the first passage, passing the second end of the fastening band through the first passage, the inner chamber of the body and the second passage, causing the engagement component to engage with the engagement teeth of a portion of the second end region of the fastening band.

One example method, further comprises providing the fastening band with a predetermined tension.

According to another aspect of the present invention, there is provided a method of manufacturing a fastener comprising an elongate fastening band having a longitudinal axis and first and second planar surfaces, the longitudinal axis defining a longitudinal axis of the fastener, the first surface defining a plurality of teeth arranged substantially perpendicular to the longitudinal axis, and the second surface providing an engagement surface for the fastener, wherein the elongate fastening band has a first end region, and a locking portion which is spaced apart longitudinally from the first end region, the first end region and locking portion defining respective groups of such teeth on the first surfaces thereof; and a buckle engaged with the teeth of the first end region of the elongate fastening band, the buckle and elongate fastening band being arrangeable to form a closed fastener configured to compress or clamp at least one article encircled by the elongate fastening band, and the buckle comprising a body defining an inner chamber, and having first and second end walls to respective opposite ends of the inner chamber and defining first and second passages therethrough, which passages are contiguous with the inner chamber and which are adapted for receiving the locking portion of the elongate fastening band therethrough, the body further having upper and lower walls to respective upper and lower sides of the inner chamber, the upper wall defining an access aperture therethrough such that the inner chamber is open to the upper side thereof; and a locking component located through the access aperture into the inner chamber, the locking component having at least one tooth for engaging the teeth on the first surface of the locking portion of the fastening band, the locking component being resiliently biased into the inner chamber of the body so as to engage the teeth of the fastening band when the fastener is formed in a closed loop, the method comprising the steps of placing a first end region of a fastening band into a moulding tool, the moulding tool being for such a buckle; closing the moulding tool, thereby holding the fastening band in place therein; performing a moulding operation using the moulding tool, thereby to fuse the buckle to the teeth on the first end region of the fastening band; ejecting a partially-completed fastener from the moulding tool; inserting a locking component into the inner chamber of the body of the buckle through the access aperture thereof.

One example method further comprises, in advance of the moulding operation, heating at least a portion of the first end region of the fastening band.

In one example, the method further comprises preparing the fastening band including the steps of: co-extruding a first polymer material with at least one reinforcing element to form an elongate fastening band having a longitudinal axis, first and second planar surfaces, and at least one reinforcing element extending longitudinally through the first polymer material between the first surface and the second surface; forming a plurality of teeth on the first planar surface, which teeth are arranged substantially perpendicularly to the longitudinal axis, so as to form a length of fastening band; cutting the length of fastening band to a required length, which required length is independent on the moulding tool of the moulding operation.

The reinforcing element may be a fibre, a yarn, wire or other elongate element. The reinforcing element may be of glass fibre, steel or aramid, for example.

In one example, the first end region of the fastening band extends into the lower wall, and a portion of the first end region at least partially overlaps the inner chamber of the body. In such an example, the second passage may overlap a portion of the first end region of the fastening band.

In one example, the body and the locking component are separate to one another and are of different materials, and the locking component is releasably connected to the body.

In one example, the elongate fastening band includes at least one reinforcing element that extends substantially parallel through the fastening band between the first and second planar surfaces thereof.

In one example, the first end region of the band is substantially fully fused to the body of the buckle.

In one example, the band is of a first polymer material, and the body of the buckle is of a second polymer material. In such an example, the first and second polymer materials are substantially identical to one another.

In one example, the moulding operation is an injection moulding operation. In another example, the moulding operation may employ another moulding technique such as casting or makes use of PU pourable moulds.

According to another aspect of the present invention, there is provided a fastener having an elongate fibre-reinforced fastening band and a buckle for engagement with the band to form a closed loop fastener, the buckle being overmoulded on a first end region of the fibre-reinforced fastening band.

DETAILED DESCRIPTION OF THE PREFERRED EMBODIMENTS

Figure 1:
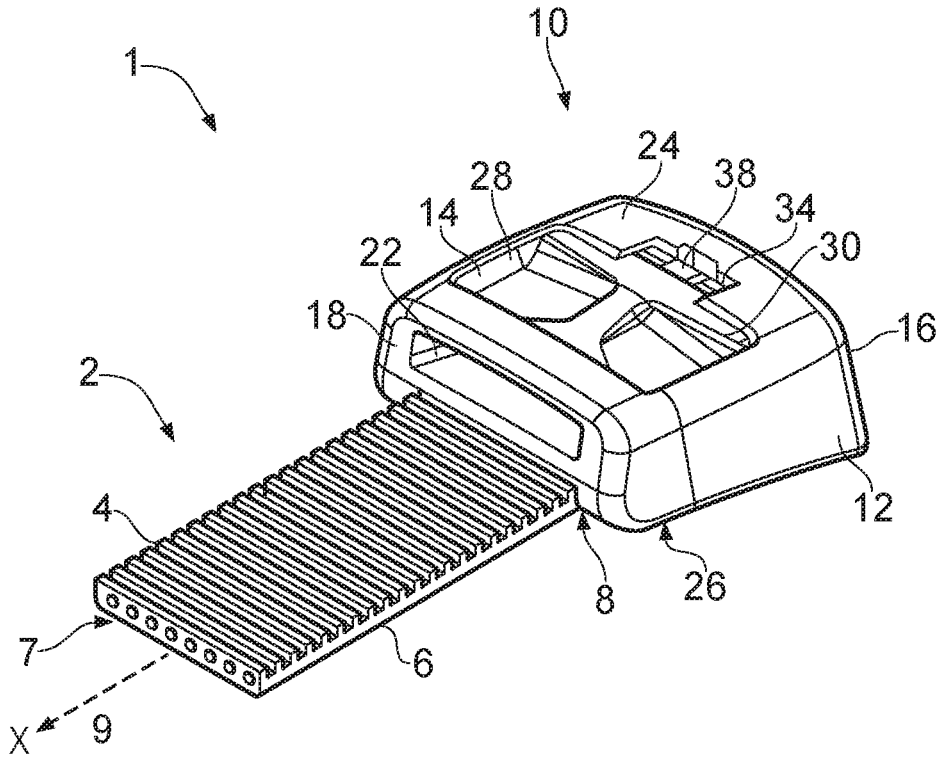
FIGS. 1 and 2 are perspective and plan views respectively of an embodiment of the present invention.
Figure 2:
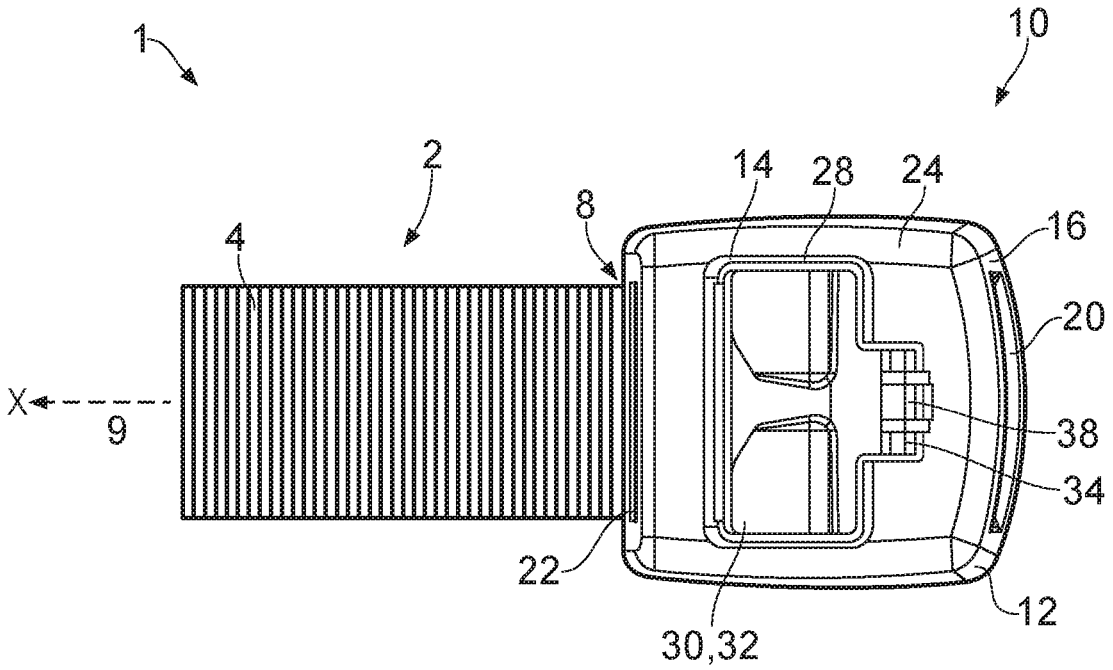

FIGS. 1 and 2 illustrate perspective and plan views respectively of an embodiment of the present invention, which provides a fastener 1 having a fastening band 2, and a buckle 10. The fastening band 2 extends from the buckle 10 in a direction illustrated by arrow X. In use, the fastening band to extends around an object and engages with the buckle 10, so as to enclose the object. In the Figures, for the sake of clarity, the fastening band 2 is shown in shortened form. It will be readily appreciated that the fastening band 2 is of sufficient length to surround circumferentially the object to which the fastener is attached.

In an embodiment of the present invention, the fastening band 2 is of elongate form and defines a longitudinal axis of the fastener 1. The fastening band 2 has a first planar surface which defines a series of engagement teeth 4. The engagement teeth 4 extend laterally across the fastening band 2, substantially perpendicular to the longitudinal axis of the fastening band 2. The fastening band 2 defines a second planar surface 6, substantially parallel to the first surface, which second surface 6 defines an engagement surface of the fastener 1. The fastening band 2 is a continuously reinforced band, having a plurality of reinforcing elements 7 that extend along the band 2 substantially parallel to the longitudinal axis of the band 2. The reinforcing elements 7 contained within the band material, for example using a co-extrusion technique, and provide increased strength for the band, compared with a band that does not make use of such reinforcement. The reinforcing elements may be of any suitable material, such as glass fibre yarn, steel wire, aramid fibres, or similar materials.

The fastening band 2 has a first end region 8 which engages with the buckle 10, as will be described in more detail below, and a second end region 9 (or locking portion), spaced apart from the first end region along the longitudinal axis of the fastening band 2. The second end region 9 of the fastening band 2 is releasably engageable with the buckle 10, thereby to form a closed loop fastener.

The buckle 10 comprises a body 12 which defines an inner chamber 14. The body 12 has a first end wall 16 and a second end wall 18, the first and second end walls 16 and 18 being spaced apart in the direction of the longitudinal axis of the fastener 1. The first end wall 16 defines a first passage 20 therethrough which extends to the inner chamber 14, such that the inner chamber 14 is accessible through the first end wall 16. The second end wall 18 defines a second passage 22 which extends to the inner chamber 14 such that the inner chamber 14 is accessible through the second end wall 18. The fastening band 2 extends from the second end wall 18 of the body 12. In use, in order to form a closed loop fastener, the fastening band 2 passes through the first and second passages 20 and 22, such that a portion of the second end region 9 of the fastening band 2 is located in the inner chamber 14 of the body 12. The fastening band 2 is held in place in the body 12 of the buckle 10, as will be described below.

The body 12 of the buckle 10 has an upper wall 24, and a lower wall 26 which provides a portion of an engagement surface of the fastener. An access aperture 28 is provided in the upper wall 24, the access aperture 28 extending through the upper wall 24 to the inner chamber 14, such that the inner chamber 14 is accessible through the upper wall 24. A locking component 30 is located within the access aperture 28 and extends into the inner chamber 14. In use, the locking component 30 engages with the engagement teeth 4 of the second end region 9 of the fastening band 2 so as to secure the fastener 1 around an object.

The lower wall 26 may have a concave curved shape to fit with an outer surface of the object being held in place.

Figure 3:
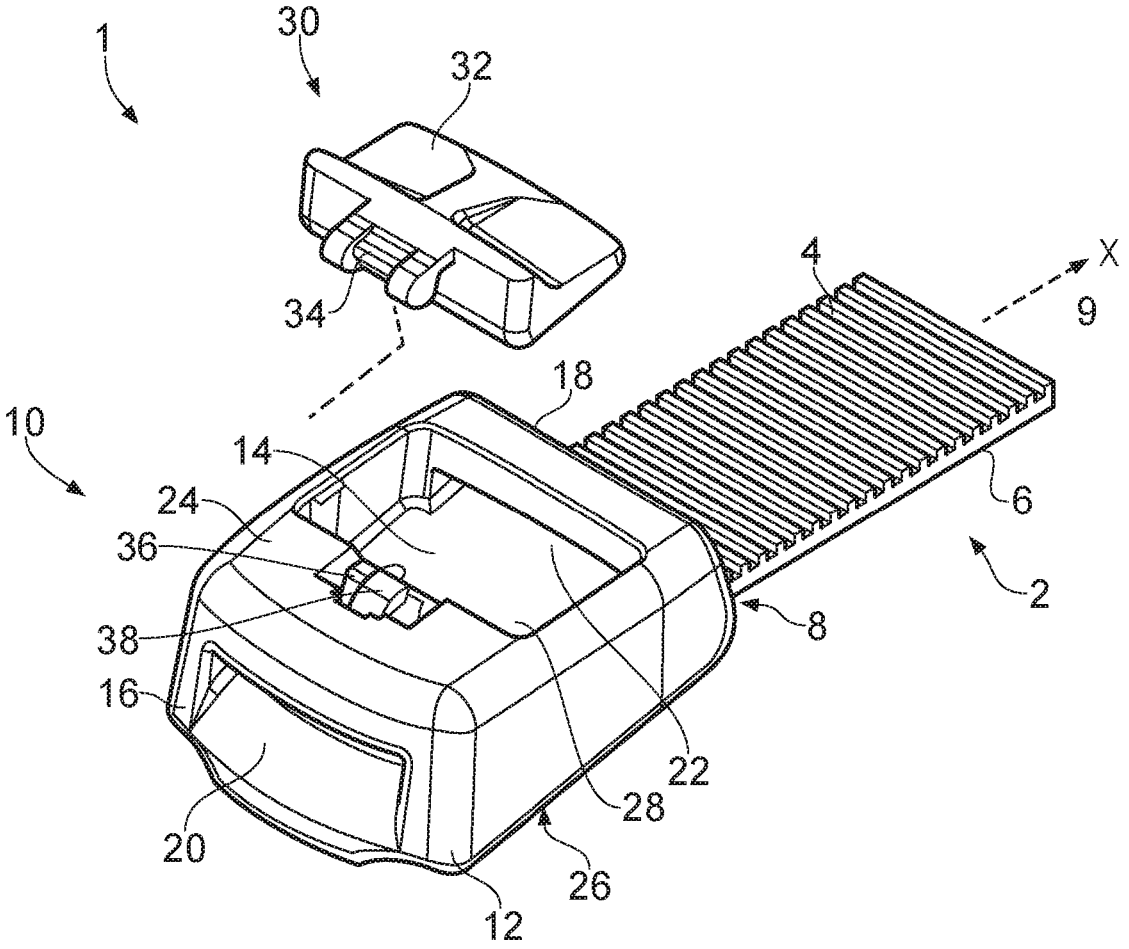
FIG. 3 is a perspective exploded view of the embodiment of FIGS. 1 and 2.

FIG. 3 illustrates the embodiment of FIGS. 1 and 2, in exploded view, with the locking component 30 separated from the body 12 of the buckle 10. The locking component 30 comprises an engagement portion 32 which is configured to engage with the fastening band 2. A hinge portion 36 extends from the engagement portion 32, and releasably engages with a reception portion 34 located adjacent the inner chamber 14 of the body 12. The reception portion 34 is configured to receive the hinge portion 36 of the locking component 30, and includes a biasing component 38 which serves to bias the engagement portion 32 into the inner chamber 14, thereby to engage the engagement teeth 4 of the fastening band 2, when the fastener is in use. In one example, the reception portion 34 is formed integrally with the body 12. In another possible example, the reception portion 34 is inserted into the body 12 through an aperture 40 in the lower surface 26 of the body 12, and the body 12 and reception portion 34 have cooperating features of shape that serve to retain the reception portion 34 in place in the body.

In order to form a closed loop fastener, the fastening band 2 is passed around the objects being secured, and is inserted into the body 12 through the first passage 24 in the first end wall 16 of the body 12 of the buckle 10. The fastening band 2 is then moved through the inner chamber 14, and passed through the second passage 26 in the second end wall 18. The second end region 9 of the fastening band 2 is then located in the inner chamber 14, such that the engagement teeth 4 of the second end region 9 engage with the engagement portion 32 of the locking component 30. The engagement portion 32 is biased into contact with the fastening band 2, thereby retaining the fastening band 2 in the buckle 10.

Figure 4:
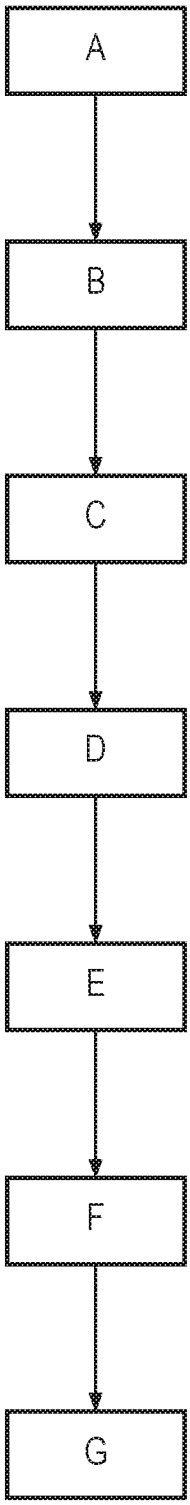
FIG. 4 is a flowchart illustrating steps in a method of manufacture of the embodiment of the present invention.

In accordance with the principles of one aspect of the present invention, the embodiment shown in FIGS. 1 to 3 is manufactured using an overmoulding technique, as will now be described with reference to the flow chart of FIG. 4, and to FIGS. 5 to 11.

Figure 5:
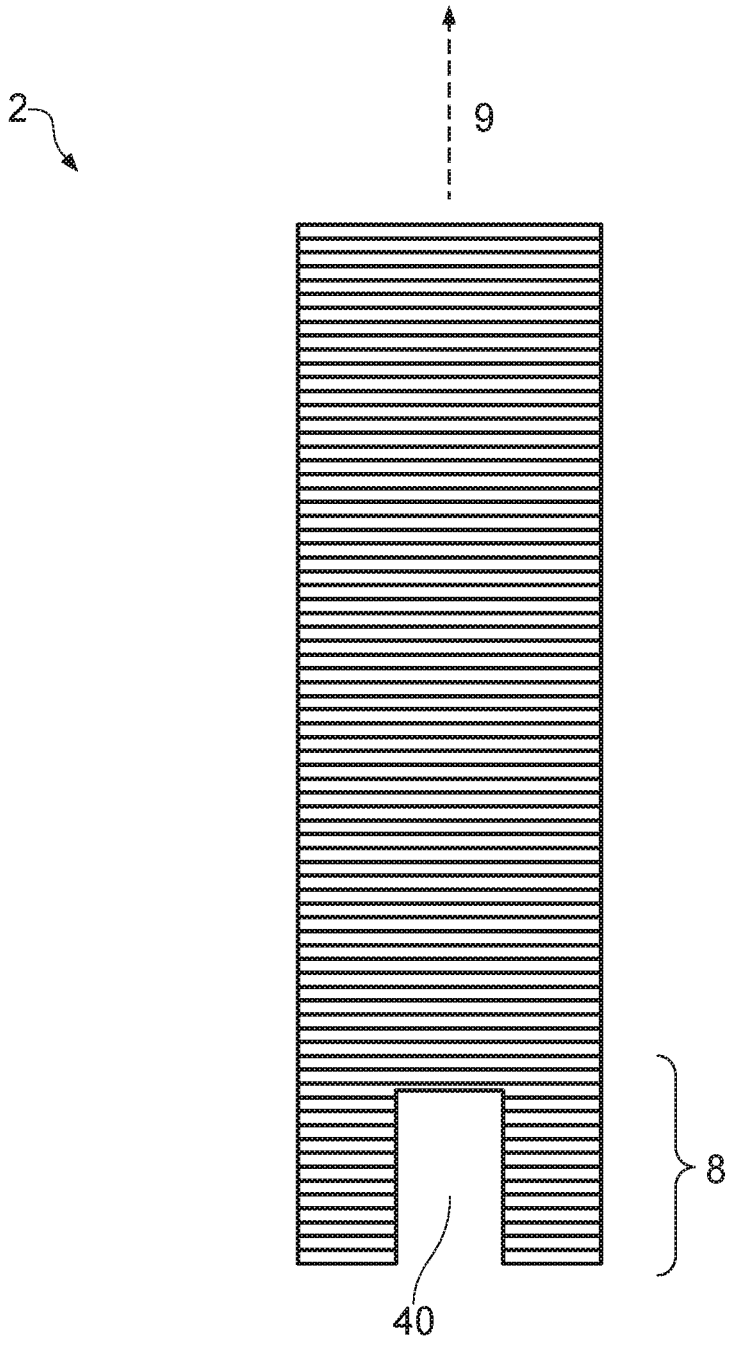
FIGS. 5, 6 and 7 illustrate a fastening band for use in an embodiment of the present invention
Figure 6:
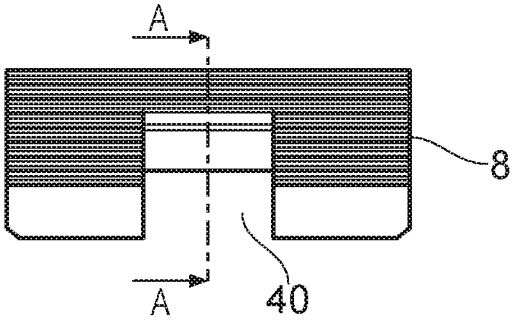
Figure 7:
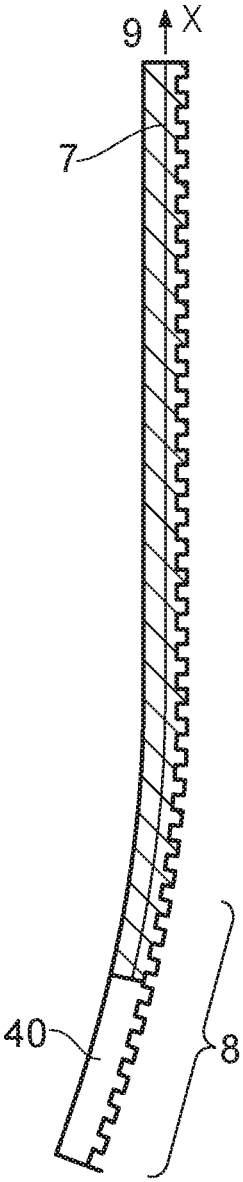

Firstly, the fastening band 3 is prepared (step A). The fastening band is prepared in accordance with known practice, preferably using a moulding technique, in which polymer material is moulded around the reinforcing fibres 7 to provide the required engagement teeth 4 and the elongate shape of the fastening band 2. The fastening band 2 is cut to a required length, appropriate for the application for which the fastener 1 is intended. In accordance with the principles of the present invention, the fastening band 2 may be of any length. As illustrated in FIGS. 5, 6 and 7, the first end region 8 of the fastening band 2 may include a cut out 40. The cut out 40 may be provided in order to enable the reception portion 34 to be inserted into the body 12 of the buckle 10. A cut out may be provided in order to maximise the length of the first end region 8 of the fastening band 2 located in the buckle 10. It will be readily appreciated that other configurations of the first end region 8 of the fastening band 2 may be used. For example, there may not be the need or requirement to provide the cut out 36 in the first end region 8.

The first end region 8 of the fastening band 2 is then held in place in a moulding tool, which is closed around the first end region 8 (step B). The moulding tool provides a mould for the body 12 of the buckle 10. Before moulding, the first end region 8 of the fastening band 2 may be heated (step C), for example, by the use of hot air within the moulding tool. Such heating can improve contact between the first end region 8 and the body 12. In accordance with the principles of the present invention, a single moulding tool may be used for any length of fastening band 2. The moulding technique is preferably an injection moulding technique, although other techniques such a casting, or a technique that uses PU pourable moulds, could be used for preparation of the buckle.

Since the fastening band 2 is prepared in advance of the overmoulding step, and only one end region of the band is placed in the moulding tool, the band length is not constrained by the moulding process. This is in contrast with previously-considered fastener designs in which the band and buckle are moulded in a single step, which leads to the need for specific moulding tools, or adjustable tools, for different lengths of fastening band 2, and to significant difficulties that prevent the reinforcement fibres being moulded into the band.

An injection moulding process is then performed (step D), in which a suitable polymer material is injected into the injection moulding tool, in line with well-known and understood practice. In this step, the body is formed in the mould in such a way as to engage with the teeth of the fastening band 2.

The polymer may be the same as that of the fastening band 2, may be similar to that of the fastening band 2, or may be different to that of the fastening band 2. When the polymer materials of the fastening band 2 and buckle 10 are the same or similar, then a close bond can be formed between the two parts during the injection moulding process. The injection moulding process can be carried out at a temperature that causes the polymer material of the fastening band to melt, and thereby bond with the material of the buckle 10.

The reinforcing fibres 7 of the fastening band 2 extend fully into the overmoulded buckle 10 in order to provide increased strength of the fastener.

Figure 8:
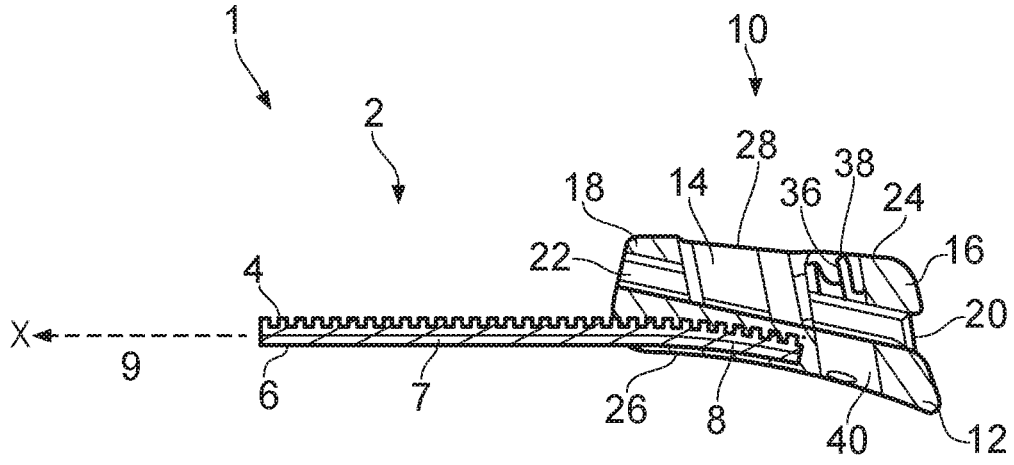
FIG. 8 is a cross-sectional side view of a partially-completed embodiment of the present invention.
Figure 9:
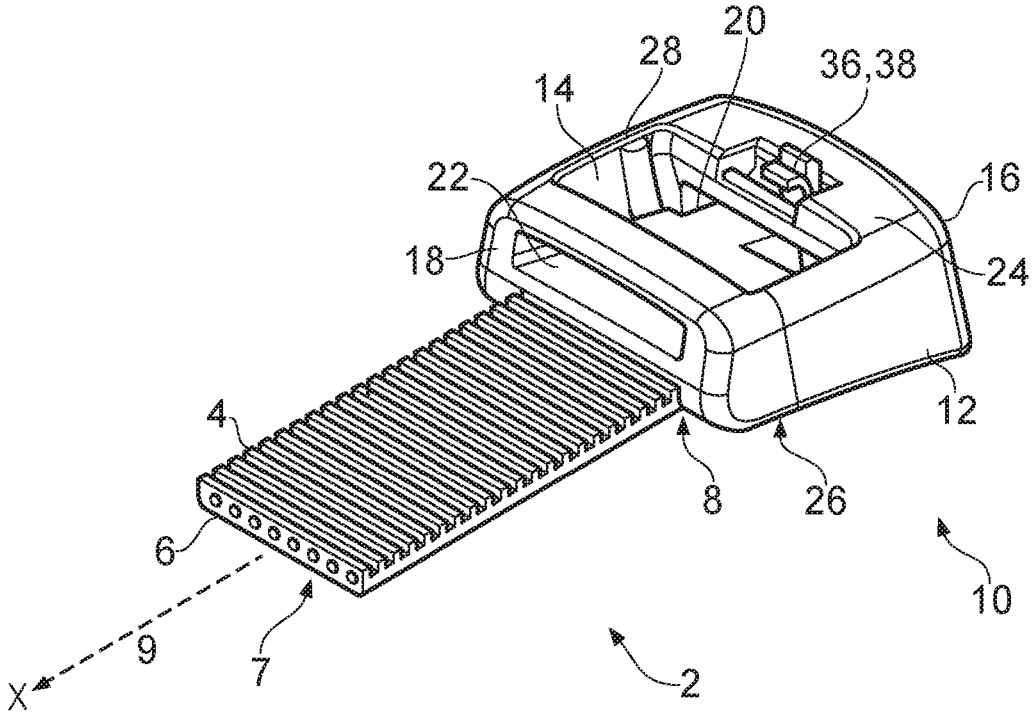
FIGS. 9 and 10 are perspective views of a partially-completed embodiment of the present invention.
Figure 10:
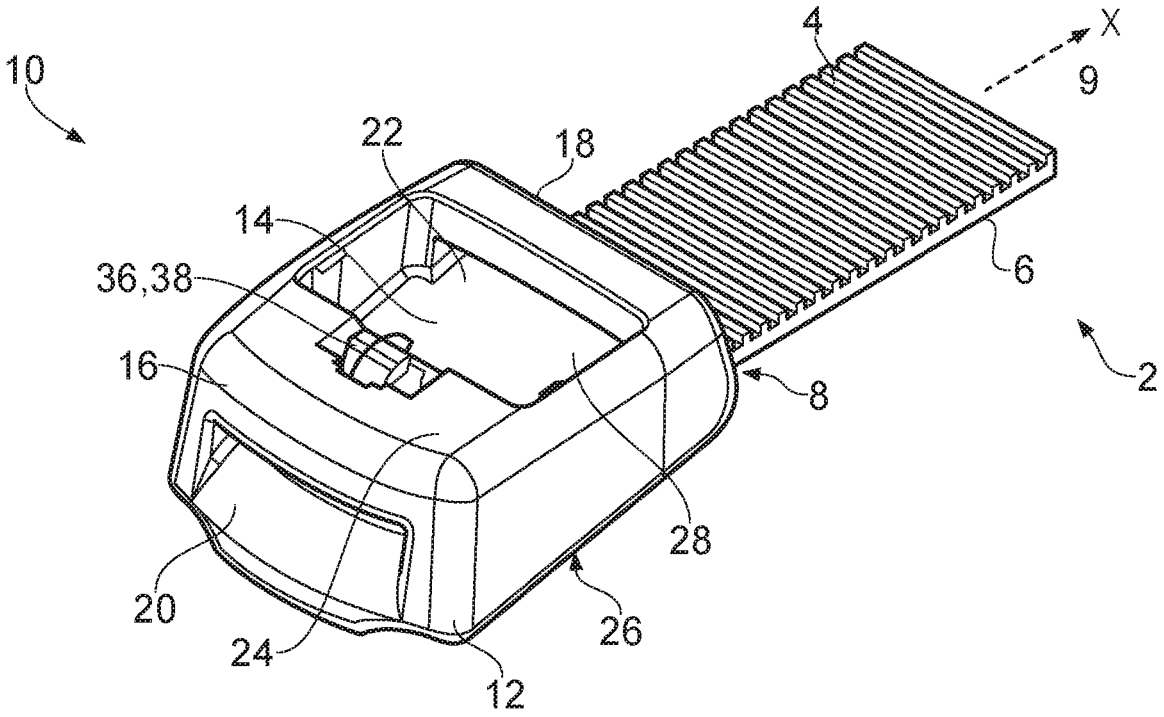
Figure 11:
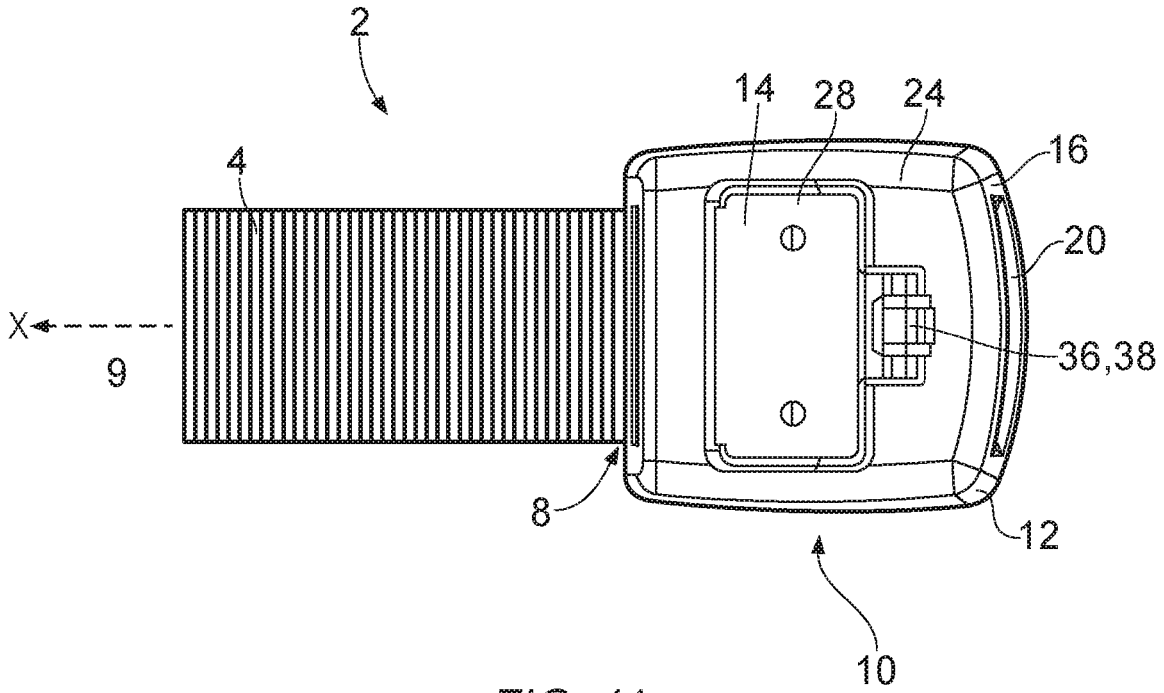
FIG. 11 is a plan view of a partially-completed embodiment of the present invention.

Following the injection moulding process of step D, the body 12 is ejected from the injection moulding tool (step E), resulting in the partially-completed fastener 1' shown in FIGS. 8 to 11. FIG. 8 illustrates a side cross-sectional view of the partially-completed fastener 1', and shows the first end region 8 of the fastening band 2 integrated with the body 12 of the buckle 10. The body of the buckle is engaged with the teeth of the first end region of the band. In this example, the body is fused to the teeth by the overmoulding step. The first end region 8 extends beneath the inner chamber 14 through a lower region of the body 12, and out through the second end wall 18, below the second passage 26. FIGS. 9, 10 and 11 illustrate perspective and plan views respectively of the partially-completed fastener 1'.

In order to complete the fastener 1, the reception portion 34 is inserted into the body 12, if the reception portion is not formed as an integral part of the body during the injection moulding process (step F). The locking component 30 is then inserted into the reception portion 34 (step G), thereby completing the fastener 1.

As described above, in order to form a closed loop fastener, the fastening band 2 is passed around the objects being secured, and is inserted into the body 12 through the first passage 20 in the first end wall 16 of the body 12 of the buckle 10. The fastening band 2 is then moved through the inner chamber 14, and passed through the second passage 22 in the second end wall 18. A portion of the second end region 9 of the fastening band 2 is then located in the inner chamber 14, such that the engagement teeth 4 of the second end region 9 engage with the engagement portion 32 of the locking component 30. The engagement portion 32 is biased into contact with the fastening band 2 by the biasing component 38, thereby retaining the fastening band 2 in the buckle 10.

As described above, the fastening band 2 includes a plurality of reinforcing fibres 7 (for example, glass fibre yarn, steel, or aramid fibres), moulded into a polymer material, such as nylon 6-6, nylon 11, acetal, polypropylene, or similar material. The buckle is preferably of the same polymer material as used in the fastening band, and so may be of nylon 6-6, nylon 11, acetal, polypropylene, or similar material.

A fastener embodying the present invention has improved strength with reduced size, compared to previously-considered designs, because of the integration of the first end region of the fastening band with the lower wall portion of the buckle. The fastener, therefore, only has a single locking component, which improves strength of the coupling, and reduces the size of the buckle. A reduced-size buckle enables the use of the fastener on objects having a smaller diameter, and hence tighter outer curvature, compared with previously-considered designs.

Fasteners embodying aspects of the present invention have several advantageous features, as will be apparent from the forgoing description. In particular, overmoulding the buckle onto a prepared fastening band allows the integration of a fibre-reinforced band with a buckle. Previously considered designs only enable a non-reinforced band to be integrated with a buckle, or require the use of a separate two-latch buckle with a reinforced band.

The band of a fastener embodying the principles of the present invention can be of any length. The overmoulding technique described above requires only one end of the band to be held in the moulding tool, which means that the band can be of any desired length. Previously-considered designs using integrated buckles have length limitations on the band due to restrictions on injection moulding length, and the need for a specific or adjustable tool for each length of band.

Such a fastener has higher strength compared to previously-considered designs due to the provision of a fibre reinforced fastening band with an integrated buckle at one end of the fastener. Such a design removes one locking arrangement, and replaces it with a bonded component. This higher strength is particularly useful during the installation process in which the fastening band is passed around an object or objects, passed through the buckle and tightened. The tension experienced during the installation process may be much higher than that experienced by the fastener once installed, due to the relaxation of the locking arrangement. Removing the locking arrangement from one end of the fastener provides greater strength at the one end of the fastener, and hence a larger safety margin during the installation process.

Fasteners embodying the present invention are particularly useful in harsh environments in which high strength and durability are required. For example, fasteners embodying the present invention are particularly useful for subsea and marine applications, such as in the oilfield industry where such fasteners may be used to attach cables and the like to pipelines or other structures.

It will be readily appreciated that the terms "upper", "lower", "inner", "end", "below", and "beneath" etc are used for the sake of simplicity and clarity and are not intended to confer any particular orientation on the parts being described. It will be appreciated that the fastener embodying the principles of the present invention may be used in any orientation suitable for the application.

The invention claimed is:

1. A fastener comprising:

an elongate extruded fibre-reinforced fastening band having a longitudinal axis and first and second planar surfaces, the longitudinal axis defining a longitudinal axis of the fastener, the first surface defining a plurality of teeth arranged substantially perpendicular to the longitudinal axis, and the second surface providing an engagement surface for the fastener, wherein the elongate extruded fibre-reinforced fastening band has a first end region, and a locking portion which is spaced apart longitudinally from the first end region, the first end region and locking portion defining respective groups of such teeth on the first surfaces thereof; and an injection-moulded buckle over-moulded onto the first end region of the fastening band and fused with the teeth of the first end region of the elongate extruded fibre-reinforced fastening band, the buckle and elongate extruded fibre-reinforced fastening band being arrangeable to form a closed fastener configured to compress or clamp at least one article encircled by the elongate extruded fibre-reinforced fastening band, and the buckle comprising:

a body defining an inner chamber, and having first and second end walls to respective opposite ends of the inner chamber and defining first and second passages therethrough, which passages are contiguous with the inner chamber and which are adapted for receiving the locking portion of the elongate extruded fibre-reinforced fastening band therethrough, the body further having upper and lower walls to respective upper and lower sides of the inner chamber, the upper wall defining an access aperture therethrough such that the inner chamber is open to the upper side thereof; and a locking component located through the access aperture into the inner chamber, the locking component having at least one tooth for engaging the teeth on the first surface of the locking portion of the extruded fibre-reinforced fastening band, the locking component being resiliently biased into the inner chamber of the body so as to engage the teeth of the extruded fibre-reinforced fastening band when the fastener is formed in a closed loop.

2. A fastener as claimed in claim 1, wherein the first end region of the elongate extruded fibre-reinforced fastening band extends into the lower wall of the buckle, and a portion of the first end region of the elongate extruded fibre-reinforced fastening band at least partially overlaps the inner chamber of the body.

3. A fastener as claimed in claim 2, wherein the second passage overlaps a portion of the first end region of the elongate extruded fibre-reinforced fastening band.

4. A fastener as claimed in claim 1, wherein the body and the locking component are separate to one another and are of different materials, and wherein the locking component is releasably connected to the body.

5. A fastener as claimed in claim 1, wherein the elongate extruded fibre-reinforced fastening band includes at least one reinforcing element that extends substantially parallel through the elongate extruded fibre-reinforced fastening band between the first and second planar surfaces thereof.

6. A fastener as claimed in claim 5, wherein the or each reinforcing element extends longitudinally through the elongate extruded fibre-reinforced fastening band.

7. A fastener as claimed in, claim 1 wherein the band is of a first polymer material, and the body of the buckle is of a second different polymer material.

8. A fastener as claimed in claim 1, wherein the locking component is pivotable relative to the buckle in a direction transverse to the longitudinal axis of the elongate extruded fibre-reinforced band.

9. A fastener as claimed in claim 1, wherein the elongate extruded fibre-reinforced fastening band comprises extruded glass fibres, steel fibres or aramid fibres.

10. A fastener comprising:

an elongate fastening band comprising reinforced fibres, the elongate fastening band having a longitudinal axis and first and second planar surfaces, the longitudinal axis defining a longitudinal axis of the fastener, the reinforced fibres extending along the longitudinal axis, the first surface defining a plurality of teeth arranged substantially perpendicular to the longitudinal axis, and the second surface providing an engagement surface for the fastener, wherein the elongate fastening band has a first end region, and a locking portion which is spaced apart longitudinally from the first end region, the first end region and locking portion defining respective groups of such teeth on the first surfaces thereof; and a buckle fused with the teeth of the first end region of the elongate fastening band, the buckle and elongate fastening band being arrangeable to form a closed fastener configured to compress or clamp at least one article encircled by the elongate fastening band, and the buckle comprising:

a body defining an inner chamber, and having first and second end walls to respective opposite ends of the inner chamber and defining first and second passages therethrough, which passages are contiguous with the inner chamber and which are adapted for receiving the locking portion of the elongate fastening band therethrough, the body further having upper and lower walls to respective upper and lower sides of the inner chamber, the upper wall defining an access aperture therethrough such that the inner chamber is open to the upper side thereof; and a locking component located through the access aperture into the inner chamber, the locking component having at least one tooth for engaging the teeth on the first surface of the locking portion of the fastening band, the locking component being resiliently biased into the inner chamber of the body so as to engage the teeth of the fastening band when the fastener is formed in a closed loop, wherein the fastening band comprises a first polymeric material and the body comprises a second, different polymer material.

* * * * *